US006644147B1

(12) United States Patent
Huang

(10) Patent No.: US 6,644,147 B1
(45) Date of Patent: Nov. 11, 2003

(54) RATCHET DEVICE FOR A SCREWDRIVER

(76) Inventor: Chin-Tan Huang, No. 39, Lane 240, Li-Jen Rd., Ta-Li City, Taichung County (TW)

( * ) Notice: Subject to any disclaimer, the term of this patent is extended or adjusted under 35 U.S.C. 154(b) by 0 days.

(21) Appl. No.: 10/226,270

(22) Filed: Aug. 23, 2002

(51) Int. Cl.[7] ..... B25B 13/46

(52) U.S. Cl. ..... 81/62; 81/63.1; 81/58.4; 192/43.2

(58) Field of Search ..... 81/62, 60, 61, 81/63, 63.1, 63.2, 59.1, 58.4, 58; 192/43.2, 44, 45

(56) References Cited

U.S. PATENT DOCUMENTS 5,531,139 A * 7/1996 Fanchang et al. ..... 81/59.1
5,582,081 A * 12/1996 Lin ..... 81/63.1
5,687,820 A * 11/1997 Lin ..... 192/43.2
5,752,590 A * 5/1998 Lin ..... 192/44
5,974,915 A * 11/1999 Chou ..... 81/63.1
6,047,802 A * 4/2000 Huang ..... 192/43.2
6,070,503 A * 6/2000 Shiao ..... 81/62.2
6,206,160 B1 * 3/2001 Chen ..... 192/43.2
6,250,183 B1 * 6/2001 Chiang ..... 81/63.2
6,260,446 B1 * 7/2001 Hu ..... 81/62
6,305,248 B1 * 10/2001 Rowlay ..... 81/62

* cited by examiner

*Primary Examiner*—Joseph J. Hail, III
*Assistant Examiner*—Hadi Shakeri
(74) *Attorney, Agent, or Firm*—Rosenberg, Klein & Lee

(57) ABSTRACT

A ratchet device for a screwdriver includes a body partially secured in a handle of the screwdriver, a barrel partially and pivotally received in the body and a controller pivotally mounted on the body for controlling an operated direction of the ratchet device.

7 Claims, 8 Drawing Sheets

RATCHET DEVICE FOR A SCREWDRIVER

BACKGROUND OF THE INVENTION

1. Field of the Invention

The present invention relates to a ratchet device, and more particularly to a ratchet device for a screwdriver.

2. Description of Related Art

A conventional ratchet device for a screwdriver in accordance with the prior art shown in FIG. 7 comprises a pivot seat (50) having two channels (51) defined and extending into the pivot seat (50) from the outer periphery of the pivot seat (50). The two channels (51) are parallel to each other. Two pawls (51) each is reciprocally received in a corresponding one of the two channels (51) and partially extending out of the pivot seat (50). An adjusting ring (60) is pivotally mounted around the pivot seat (50). The adjusting ring (60) has two grooves (61) longitudinally defined in an inner periphery of the adjusting ring (60) and a guiding portion (62) formed on the inner periphery of the adjusting ring (60) between the two grooves (61) of the adjusting ring (60). The two grooves (61) are provided to selectively receive a distal end of a corresponding one of the two pawls (51) to change the operated direction of the screwdriver.

However, the pivot seat (50) has no enough space to centrally define a through hole to receive a long tip because the pivot seat (50) has two channels (51) defined therein such that the conventional screwdriver is in a narrow-range.

With reference to FIG. 8, another ratchet screwdriver is shown. The ratchet screwdriver includes a handle (not numbered) and a ratchet device (80) mounted in and near a bottom of the handle. A barrel (70) is rotatably and centrally received in the handle. The ratchet device (80) is connected with the barrel (70) for selectively driving the barrel (70). A switch (90) is mounted in the ratchet device (80) and partially extending through the handle for user to change the operated direction of the ratchet device (80). The conventional screwdriver can be used with a long tip because the ratchet device is mounted near the bottom of the handle and the barrel (70) extends to the ratchet device (80).

However, to mount the ratchet device (80) near the bottom of the handle for using with a long tip is an inconvenient design. The user must move the screwdriver from one hand to another for adjusting the switch (90) to change the operated direction of the screwdriver.

The present invention has arisen to mitigate and/or obviate the disadvantages of the two conventional screwdrivers.

SUMMARY OF THE INVENTION

The main objective of the present invention is to provide an improved ratchet device for a screwdriver that can be used with a long tip.

To achieve the objective, the ratchet device in accordance with the present invention includes a body adapted to be partially secured in a handle of the screwdriver. The body includes a first through hole longitudinally and centrally defined in the body, a column adapted to be securely received in the handle of the screwdriver, a pivot seat-integrally and radically extending from the body out of the handle of the screwdriver and a channel defined in the pivot seat, the channel corresponding to and communicating with the first through hole in the body. A barrel is partially and pivotally received in the first through hole in the body. The barrel has a series of teeth formed on an outer periphery thereof and a polygonal hole longitudinally and centrally defined in the barrel. A controller is pivotally mounted on the pivot seat and includes a first pawl and a second pawl each received in the channel and corresponding to each other. The first pawl and the second pawl are selectively engaged to the series of teeth on the barrel to controlling an operated direction of the barrel. A spring is received in and mounted between the first pawl and the second pawl. The spring has two opposite ends each abutting a corresponding one of the first pawl and the second pawl. A cover is pivotally mounted around the pivot seat for driving the first pawl and the second pawl to selectively engage to the series of teeth on the barrel.

Further benefits and advantages of the present invention will become apparent after a careful reading of the detailed description with appropriate reference to the accompanying drawings.

DETAILED DESCRIPTION OF THE INVENTION

Figure 1:
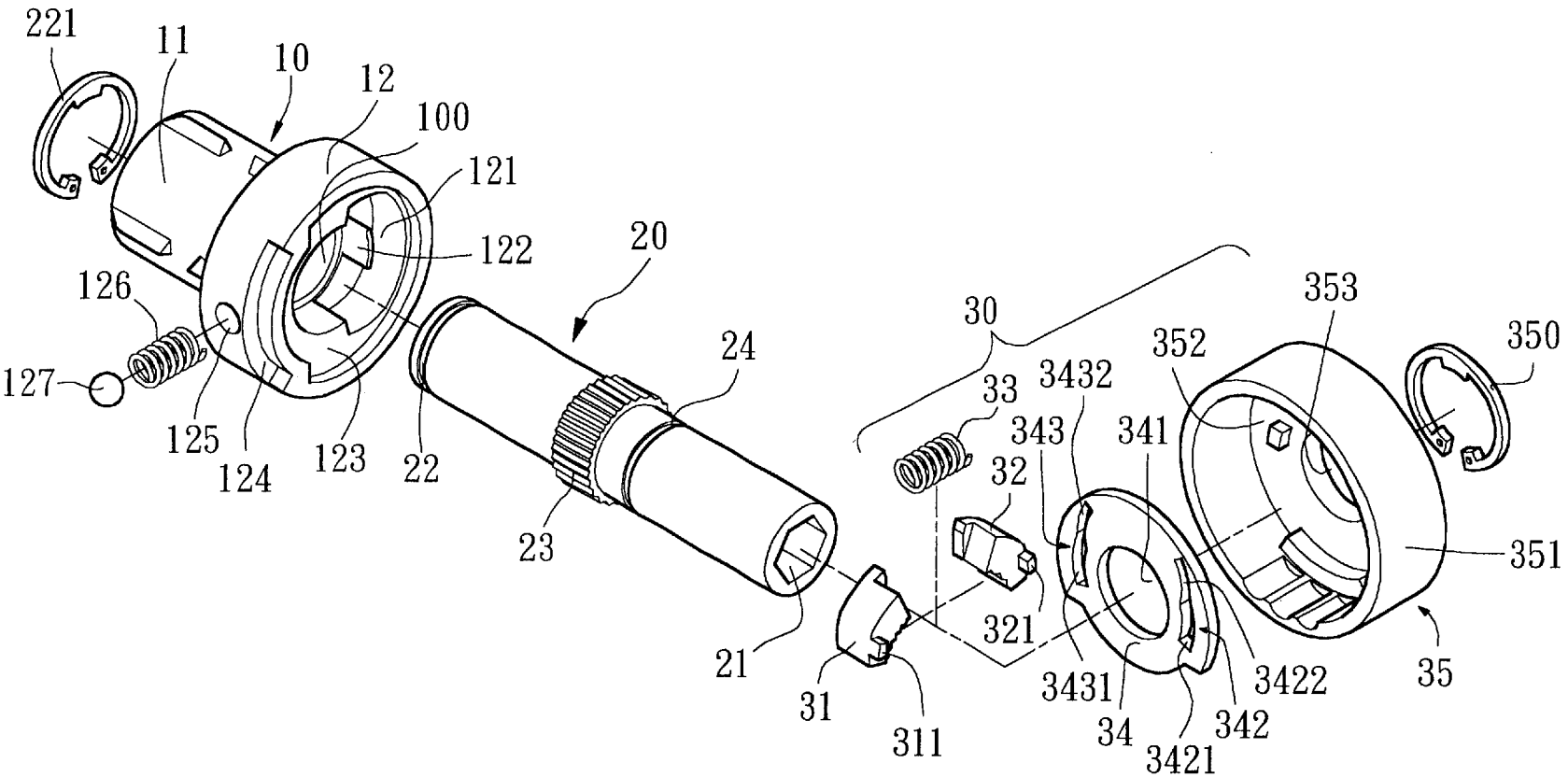
FIG. 1 is an exploded perspective view of a ratchet device for a screwdriver in accordance with the present invention.
Figure 2:
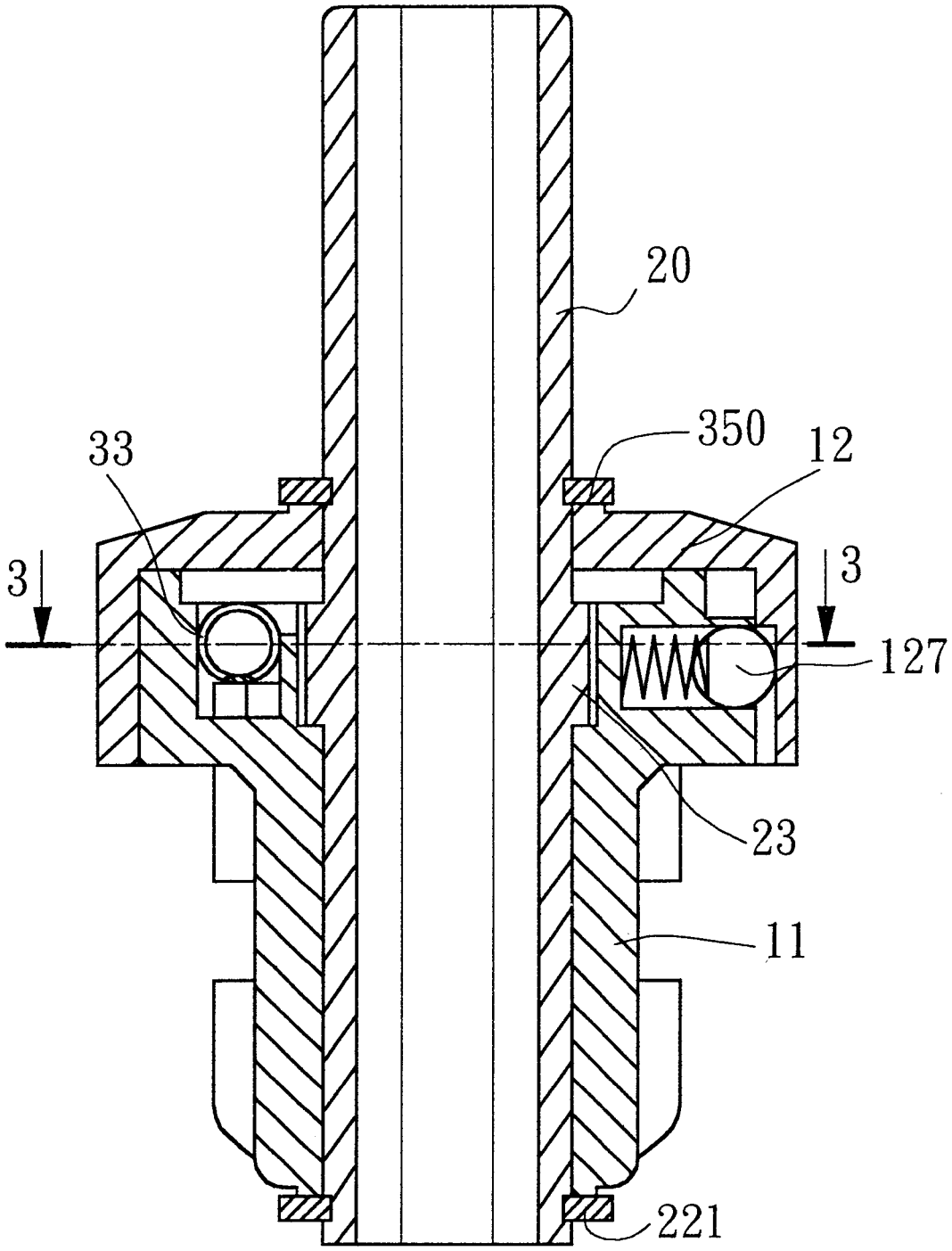
FIG. 2 is a cross sectional side plan view of the ratchet device in FIG. 1.
Figure 3:
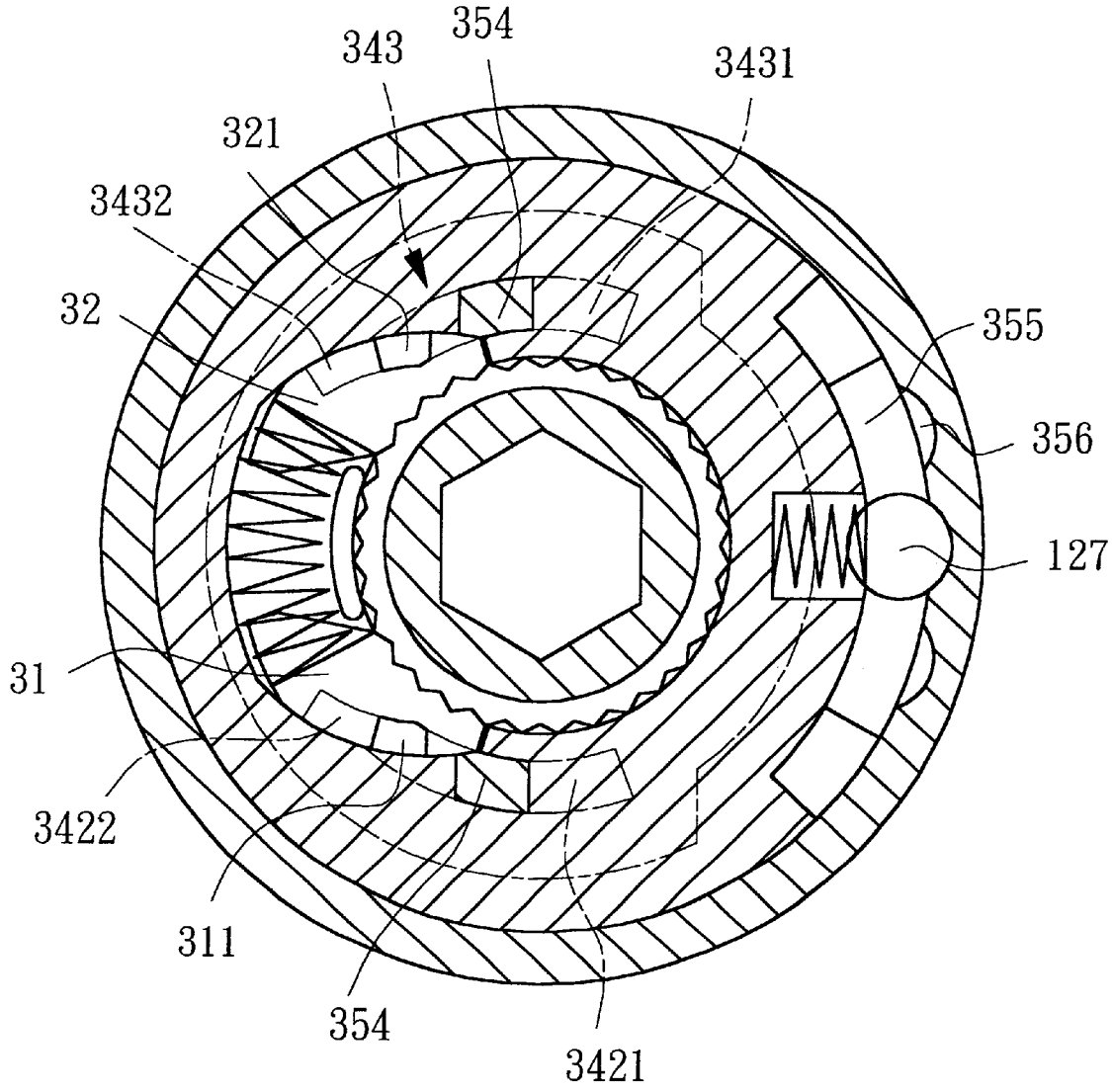
FIG. 3 is a cross sectional top plan view of the ratchet device in FIG. 2 along the line 3—3.

Referring to the drawings and initially to FIGS. 1–3, a ratchet device for a screwdriver in accordance with the present invention comprises a body (10) adapted to be partially secured in a handle (not numbered) of the screwdriver, a barrel (20) partially and pivotally received in the body (10) and a controller (30) pivotally mounted on the body (10) for controlling a operated direction of the ratchet device.

The body (10) includes a first through hole (100) longitudinally and centrally defined in the body (10). The body (10) includes a column (11) adapted to be securely inserted into the handle of the screwdriver and a pivot seat (12) integrally formed with the column (11). The pivot seat (12) has a diameter greater than that of the column (11). The first through hole (100) is a sunken hole such that the first through hole (100) has a first section in the column (11) and a second section in the pivot seat (12). The first section of the first through hole (100) is smaller than that of the second section of the first through hole (100). The pivot seat (12) includes a channel (121) defined in the pivot seat (12). The channel (121) corresponds to a periphery of the second section of the first through hole (100) and communicates with the first through hole (100). The pivot seat (12) includes a stopper (122) perpendicularly extending upwardly from a bottom of the channel (121) and a recess (123) defined in a top of the pivot seat (12). The recess (123) communicates with the first through hole (100) and the channel (121). A cutout (124) is defined in the outer periphery of the pivot seat (12) and extends to the top of the pivot seat (12). A blind hole (125) is radially defined in the pivot seat (12) and extends to the outer periphery of the pivot seat (12). A first spring (126) is compressively received in the blind hole (125) and a steel ball (127) is partially received in the blind hole (125) to compress the first spring (126).

The barrel (20) includes a polygonal hole (21) longitudinally defined in the barrel (20) and centrally extending through the barrel (20). The barrel (20) has a first end extending through the first through hole (100) in the body (10) and a first annular groove (22) defined near the first end of the barrel (20). A C-shaped ring (221) mounted on the first annular groove (22) after the first end of the barrel (20) extending through the body (10) to hold the barrel (20) in the place. A series of teeth (23) is formed on an outer periphery of the barrel (20) and corresponds to the second section of the first through hole (100) in the body (10). The series of teeth (23) has a diameter slightly smaller than that of the second section of the first through hole (100). The barrel (20) has a second end and a second annular groove (24) defined in the outer periphery of the barrel (20) between the second end of the barrel (20) and the series of teeth (23).

The controller (30) includes a first pawl (31) and a second pawl (32) respectively received in the channel (121) and corresponding to each other. The two pawls (31, 32) are selectively engaged to the series of teeth (23) of the barrel (20) to control the operated direction of the barrel (20). The first pawl (31) has a first stub (311) extending upwardly from a top thereof and the second pawl (32) has a second stub (321) extending upwardly extending from a top of the second pawl (32). The first stub (311) and the second stub (321) are respectively located near two opposite ends of the channel (121). A second spring (33) is received in the channel (121) and has two opposite ends each abutting a corresponding one of the two pawls (31, 32) to provide a restitution force when the pawls (31, 32) moved away from the barrel (20). The second spring (33) is limited in the channel (121) by the stopper (122). A guiding plate (34) is fixedly received in the recess (123) in the pivot seat (12) and a second through hole (341) defined to align with the first through hole (100) in the body (10). The guiding plate (34) has a first guiding groove (342) and a second guiding groove (343) defined therein. The first guiding groove (342) and the second guiding groove (343) each has a first portion (3421, 3431) diametrically corresponding to each other relative to the second through hole (341) and concentrically located relative to the second through hole (341). The first guiding groove (342) and the second guiding groove (343) each has a second portion (3422, 3432) extending from the first portion (3421, 3431) and directing to a periphery of the guiding plate (34). The first stub (311) is moved in the second portion (3422) of the first guiding groove (342) and the second stub (321) is moved in the second portion (3432) of the second guiding groove (343). A cover (35) is pivotally mounted around the pivot seat (12). The cover (35) includes a skirt (351) mounted around the outer periphery of the pivot seat (12) and a shoulder (352) radically extending from one end of the skirt (351) opposite to the body (10) and defining a third through hole (353) to allow the barrel (20) extending through the cover (30). A second C-shaped ring (350) in mounted on the second annular groove (24) to hold the cover (35) in place when the barrel extending through the cover (35). The cover (35) includes two drive blocks (354) and a limited block (355) each extending downwardly from a bottom of the shoulder (352). The two drive blocks (354) respectively and movably received in a corresponding one of the two first portions (3421, 3431) of the two guiding grooves (342, 343) for selectively driving the stubs (311, 321) of the two pawls (31, 32). The limited block (355) is received in and moved within the cutout (124) in the pivot seat (12) to limit the rotating-range of the cover (35). Three indentations (356) are longitudinally defined in an inner periphery of the skirt (351) to partially receive the steel ball (127) for user to easily control the rotating-range of the cover (35).

With reference to FIG. 3, the two pawls (31, 32) are engaged to the series of teeth (23) of the barrel (20) such that the barrel (20) is fixed when the steel ball (127) is partially received in a middle indentation (356) and the two drive blocks (354) are received in the two first portions (3421, 3431) of the two guiding grooves (342, 343) and separated to the two stubs (311, 321).

Figure 4:
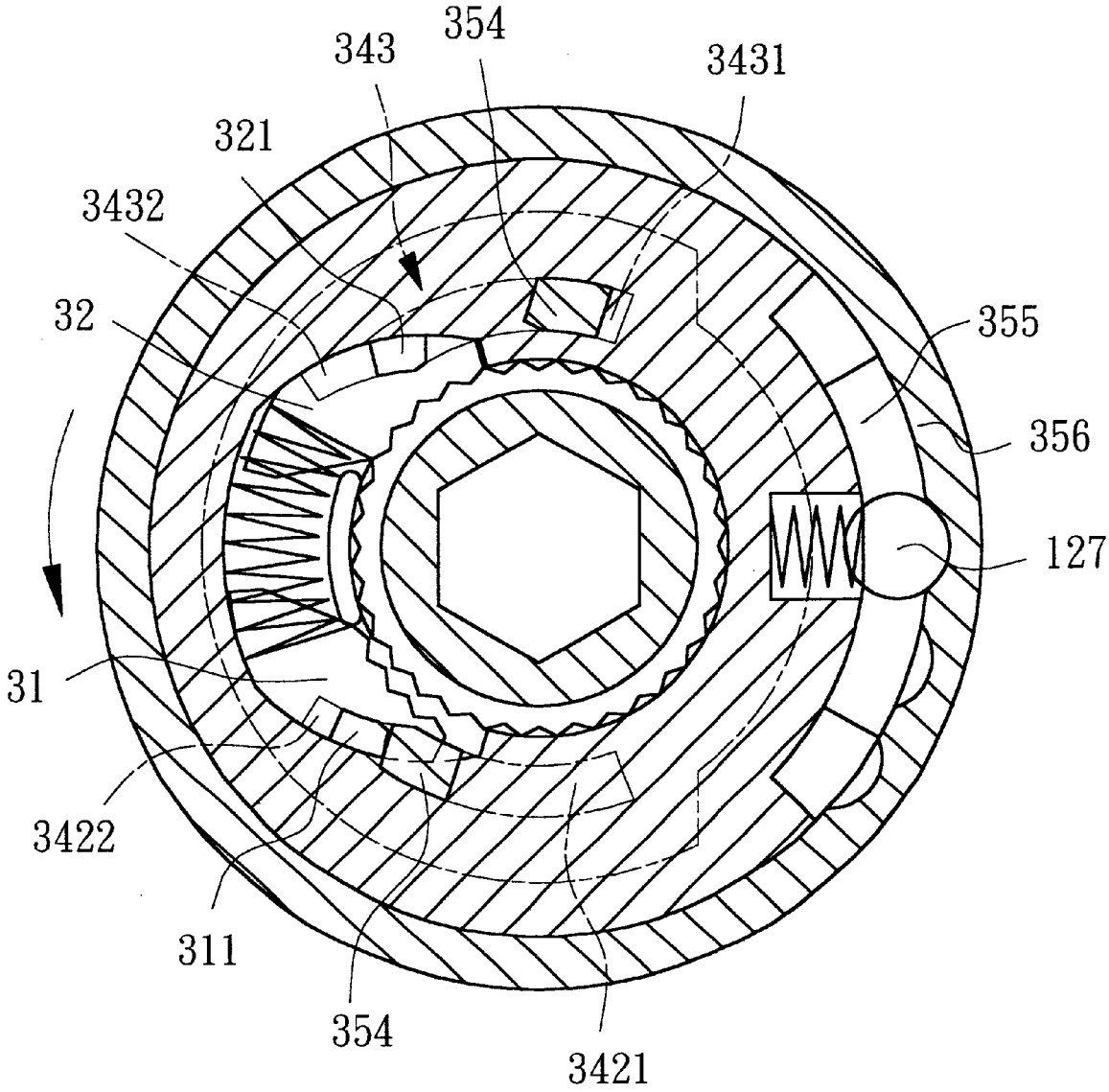
FIG. 4 is an operational top plan view of the ratchet device in FIG. 3.

With reference to FIG. 4, the drive block (354) in the first portion (3431) of the second guiding groove (343) is moved away from the second stub (321) such that the second pawl (32) selectively engaged to the series teeth (23) and the drive block (354) in the first portion (3421) of the first guiding groove (342) is moved to push the first stub (311) to make the first pawl (31) being separated relative to the series of teeth (23) when the steel ball (127) is moved into a indentation (356) near the second pawl (32). Consequently, the barrel (20) is only rotated along the arrow as shown in FIG. 4 and cannot be rotated back because the second stub (321) abuts the periphery of the first portion (3431) of the second guiding groove (343). The second pawl (32) is slightly pushed back relatively to the skirt (351) and compresses the second spring (33) so that the second pawl (32) always abuts the series of teeth (23) of the barrel (20) due to the restitution force of he second spring (33).

Figure 5:
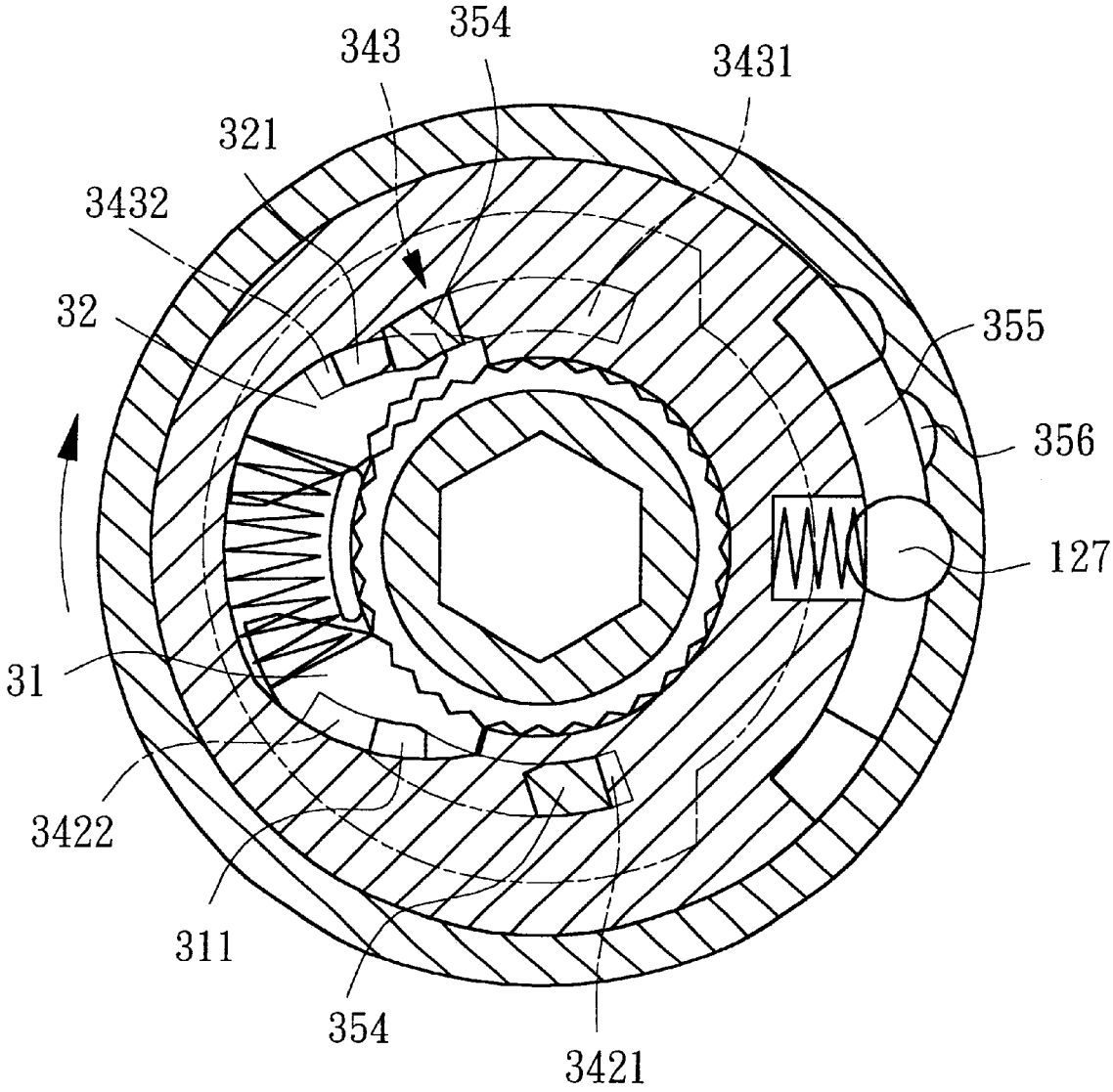
FIG. 5 is another operational top plan view of the ratchet device in FIG. 3.

With reference to FIG. 5, the drive block (354) in the first portion (3421) of the first guiding groove (342) is moved away from the first stub (311) such that the first pawl (31) selectively engaged to the series teeth (23) and the drive block (354) in the first portion (3431) of the second guiding groove (343) is moved to push the second stub (321) to make the second pawl (32) being separated relative to the series of teeth (23) when the steel ball (127) is moved into a indentation (356) near the first pawl (31). Consequently, the barrel (20) is only rotated along the arrow as shown in FIG. 5 and cannot be rotated back because the first stub (311) abuts the periphery of the first portion (3421) of the first guiding groove (342). The first pawl (31) is slightly pushed back relatively to the skirt (351) and compresses the second spring (33) so that the first pawl (31) always abuts the series of teeth (23) of the barrel (20) due to the restitution force of he second spring (33).

Figure 6:
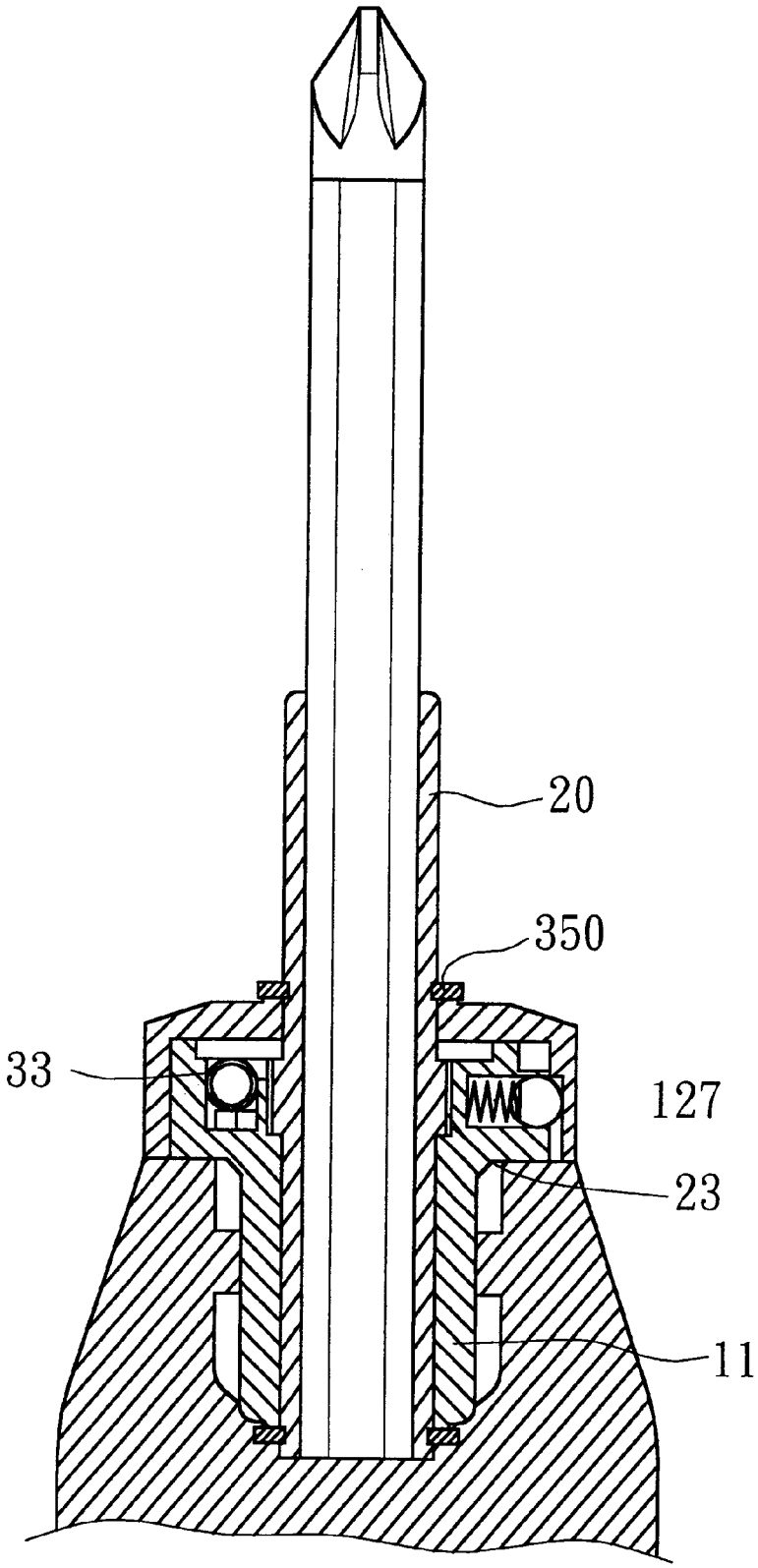
FIG. 6 is a schematic view of the ratchet device in FIG. 2 showing the ratchet device secured on a handle of the screwdriver.
Figure 7:
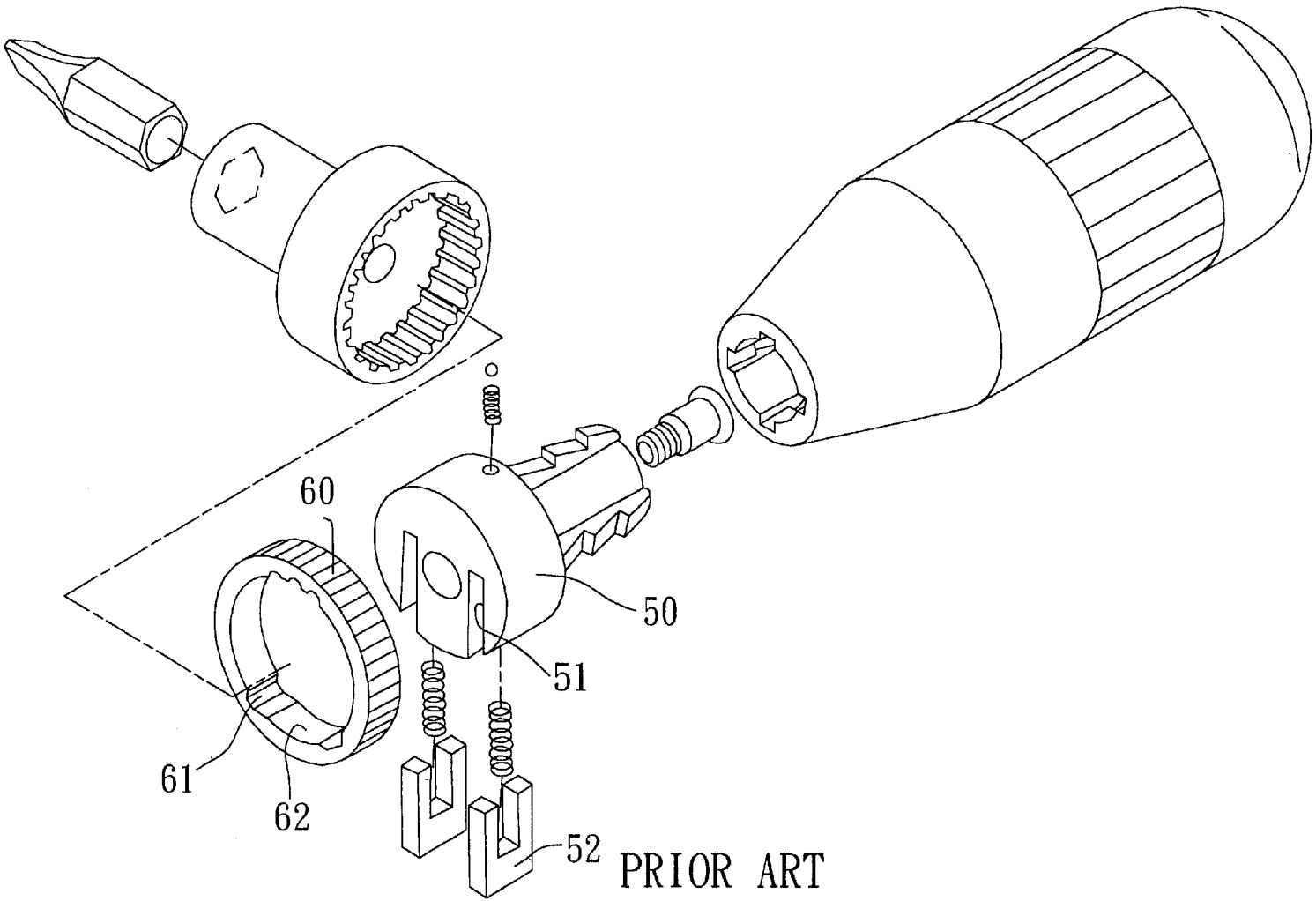
PRIOR ART FIG. 7
FIG. 7 is an exploded perspective view of a ratchet device for a screwdriver in accordance with the prior art.
Figure 8:
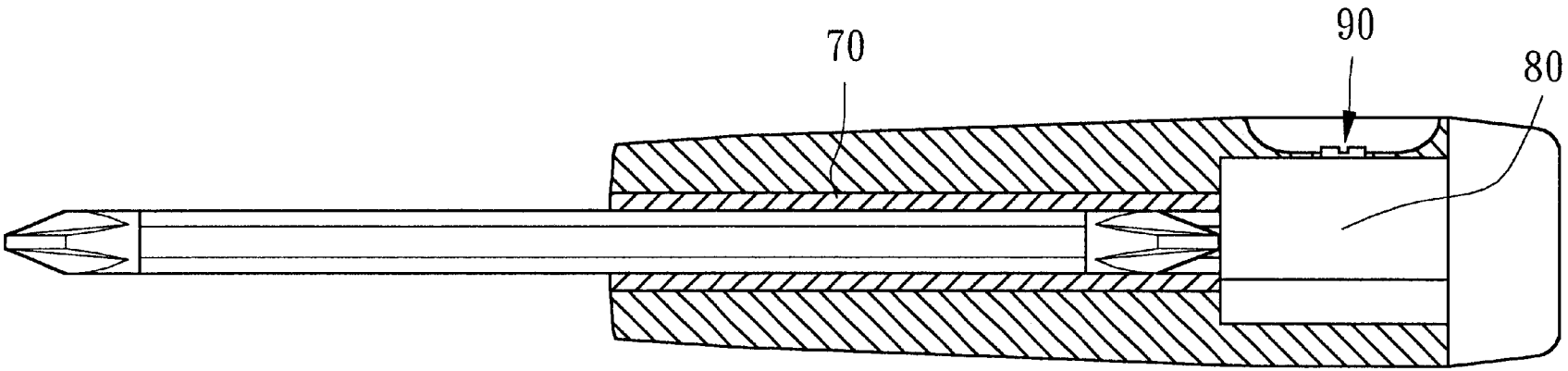
PRIOR ART FIG. 8
FIG. 8 is a cross sectional side plan view of a ratchet screwdriver in accordance with the prior art.

With reference to FIGS. 1 and 6, the series of teeth (12) in accordance with the present invention is formed on the outer periphery of the barrel (20) so that the polygonal hole (21) is easily longitudinally defined in the barrel (20) to receive a long tip and the switch for controlling the ratchet device is positioned near the top of the handle of the screwdriver. Consequently, the ratchet device in accordance with the present invention is a convenient design for user to operate with a long tip and easily change the operated direction of the screwdriver.

Although the invention has been explained in relation to its preferred embodiment, it is to be understood that many other possible modifications and variations can be made without departing from the spirit and scope of the invention as hereinafter claimed.

What is claimed is:

1. A ratchet device for a screwdriver comprising:

a body adapted to be partially secured in a handle of the screwdriver and including:

a first through hole longitudinally and centrally defined in the body, the first hole being a sunken hole;

a column adapted to be securely received in the handle of the screwdriver;

a pivot seat integrally and radially extending from the body out of the handle of the screwdriver, wherein the first through hole has a first section defined in the column and a second section defined in the pivot seat, the first section of the first through hole having a diameter smaller than that of the second section of the first through hole in the pivot seat;

a channel defined in the pivot seat, the channel corresponding to and communicating with the second section of the first through hole in the body; and a recess defined in a top of the pivot seat, the recess communicating with the first through hole and the channel in the body;

a barrel partially and pivotally received in the first through hole in the body, the barrel having a series of teeth formed on an outer periphery of the barrel and a polygonal hole longitudinally and centrally defined in the barrel, the polygonal hole extending through the barrel; and a controller pivotally mounted on the pivot seat and including:

a first pawl and a second pawl each received in the channel and corresponding to each other, the first pawl and the second pawl selectively engaged to the series of the teeth on the barrel to control an operated direction of the barrel;

a spring received in and mounted between the first pawl and the second pawl, the spring having two opposite ends each abutting a corresponding one of the first pawl and the second pawl;

a cover pivotally mounted around the pivot seat for driving the first pawl and the second pawl to selectively engage to the series of teeth on the barrel; and a guiding plate fixedly received in the recess in the pivot seat and having a second through hole defined to align with the first through hole in the body, the guiding plate having a first guiding groove and a second guiding groove defined therein, the first guiding groove and the second guiding groove each having a first portion diametrically corresponding to each other relative to the second through hole and concentrically located relative to the second through hole, the first guiding groove and the second guiding groove each having a second portion extending from the first portion and directing to a periphery of the guiding plate.

2. The ratchet device as claimed in claim 1, wherein the first pawl has a first stub extending upwardly from a top of the first pawl and the second pawl has a second stub extending upwardly from a top of the second pawl, the first stub and the second stub respectively located near two opposite ends of the channel, the first stub movably received in the second portion of the first guiding groove and the second stub movably received in the second portion of the second guiding groove.

3. The ratchet device as claimed in claim 2, wherein the cover comprises a skirt mounted around an outer periphery of the pivot seat, a shoulder radically extending from one end of the skirt opposite to the body and defining a third through hole to allow the barrel extending through the cover, and two drive blocks extending downwardly from a bottom of the shoulder, the two drive blocks respectively and movably received in a corresponding one of the two first portions of the first guiding grooves and the second guiding groove for selectively driving the stubs of the two pawls.

4. The ratchet device as claimed in claim 3, wherein the pivot seat comprises cutout defined in the outer periphery of the pivot seat and extending to a top of the pivot seat, and the cover comprises a limited block extending downwardly from the bottom of the shoulder, the limited block received in and moved within the cutout in the pivot seat to limit a rotating-range of the cover.

5. The ratchet device as claimed in claim 3, wherein the pivot seat comprises a blind hole radically defined in the pivot seat, a spring compressively received in the blind hole and a steel ball partially received in the blind hole to selectively compress the spring.

6. The ratchet device as claimed in claim 5, wherein the cover comprises three indentations longitudinally defined in an inner periphery of the skirt to partially receive the steel ball for user to easily control the rotating-range of the cover.

7. The ratchet device as claimed in claim 1, wherein the pivot seat comprises a stopper perpendicularly and upwardly extending from a bottom of the channel to hold the spring between the first pawl and the second pawl in place.

* * * * *